US009347463B2

(12) United States Patent
Tsutsui

(10) Patent No.: US 9,347,463 B2
(45) Date of Patent: May 24, 2016

(54) TURBO-MOLECULAR PUMP

(71) Applicant: Shimadzu Corporation, Kyoto (JP)

(72) Inventor: Shingo Tsutsui, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 413 days.

(21) Appl. No.: 14/013,535

(22) Filed: Aug. 29, 2013

(65) Prior Publication Data

US 2014/0072417 A1 Mar. 13, 2014

(30) Foreign Application Priority Data

Sep. 10, 2012 (JP) ..... 2012-198508

(51) Int. Cl.
*F04D 19/04* (2006.01)
*F04D 29/58* (2006.01)

(52) U.S. Cl.
CPC ..... *F04D 29/5806* (2013.01); *F04D 19/042* (2013.01); *F04D 29/584* (2013.01)

(58) Field of Classification Search
CPC .. F04D 29/5806; F04D 19/042; F04D 29/584
USPC ..... 415/175, 90, 47; 417/423.4
See application file for complete search history.

(56) References Cited

U.S. PATENT DOCUMENTS 5,618,167 A * 4/1997 Hirakawa ..... F04D 19/04 415/90
6,416,290 B1 * 7/2002 Yamauchi ..... F04D 19/04 417/423.4
6,629,824 B2 * 10/2003 Yamauchi ..... F04D 29/584 417/313
6,793,466 B2 * 9/2004 Miyamoto ..... F04D 19/04 417/423.4
6,926,493 B1 * 8/2005 Miyamoto ..... F04D 19/042 415/90
7,572,096 B2 * 8/2009 Nonaka ..... F04D 19/04 415/90
8,246,300 B2 * 8/2012 Shi ..... F04D 19/042 415/90
8,651,838 B2 * 2/2014 Birkenstock ..... F04D 17/168 417/423.4
2002/0039533 A1 * 4/2002 Miyamoto ..... F04D 29/584 417/313
2012/0034066 A1 * 2/2012 Kogame ..... F04D 19/042 415/90
2012/0143390 A1 * 6/2012 Miwata ..... F04D 29/584 700/300
2013/0189089 A1 * 7/2013 Schroder ..... F04D 19/042 415/182.1
2013/0209272 A1 * 8/2013 Omori ..... F04D 29/5813 417/26
2015/0086328 A1 * 3/2015 Tsutsui ..... F04D 29/584 415/47
2015/0184665 A1 * 7/2015 Yamato ..... F04D 29/584 415/47
2015/0219116 A1 * 8/2015 Tsutsui ..... F04D 29/584 415/175
2015/0226229 A1 * 8/2015 Tsutsui ..... F04D 29/5853 415/47

(Continued)

FOREIGN PATENT DOCUMENTS

JP 2002303293 A * 10/2002

OTHER PUBLICATIONS

Chinese Office Action for corresponding Chinese Application No. 201310360459.8 mailed Aug. 28, 2015 and translation.

*Primary Examiner* — Thai Ba Trieu
(74) *Attorney, Agent, or Firm* — Renner, Otto, Boisselle & Sklar, LLP

(57) ABSTRACT

A turbo-molecular pump includes a case member, a rotor accommodated in the case member, the rotor having rotor blades arranged in multiple steps, a rotor shaft provided coaxially with the rotor, a plurality of stator blades provided on an inner surface of the case member and arranged between the rotor blades, and a plurality of spacers for supporting the stator blades. One of the plurality of spacers has a cooling thick portion for covering an outer peripheral side surface of at least one adjacent upper or lower spacer, and a cooling pipe through which a cooling medium is circulated is provided in the cooling thick portion.

5 Claims, 5 Drawing Sheets

(56) References Cited

U.S. PATENT DOCUMENTS

2015/0240822 A1* 8/2015 Sakaguchi ..... F04D 29/5853
415/200

2015/0275914 A1* 10/2015 Tsutsui ..... F04D 29/5853
415/177

* cited by examiner

FIG. 2 Temperature distribution of spacer & rotor

TURBO-MOLECULAR PUMP

BACKGROUND OF THE INVENTION

1. Field of the Invention

The present invention relates to a turbo-molecular pump having rotor blades provided in multiple steps, stator blades provided between the rotor blades, and spacers for supporting the stator blades.

2. Description of the Related Art

In a turbo-molecular pump obtaining high vacuum or ultra high vacuum, a gas molecule suctioned from an intake port side is exhausted to an exhaust port side by a blade exhaust portion formed by rotor blades and stator blades. Frictional heat generated when the rotor blades rotated at high speed collide with the gas molecule is transmitted to a case member from the rotor blades via the stator blades.

When a temperature of a rotor having the rotor blades becomes high by the frictional heat, creep speed is accelerated. Thus, a cooling pipe is provided in the case member and a cooling medium is circulated in the cooling pipe, so as to cool the turbo-molecular pump.

In recent years, in manufacturing of a semiconductor device and the like, there is a tendency that a wafer is enlarged and a flow rate of a gas to be introduced into a process chamber is increased. When the flow rate of the gas is increased, the frictional heat in the rotor blades is increased, so that the temperature of the rotor becomes high. Therefore, only by providing the cooling pipe in the case member, the temperature of the rotor exceeds an allowable temperature and the creep speed is accelerated.

SUMMARY OF THE INVENTION

A turbo-molecular pump of the present invention includes a case member, a rotor accommodated in the case member, the rotor having rotor blades arranged in multiple steps, a rotor shaft provided coaxially with the rotor, a plurality of stator blades provided in the case member and arranged between the rotor blades, and a plurality of spacers for supporting the stator blades, wherein one of the plurality of spacers has a cooling thick portion for covering an outer peripheral side surface of at least one adjacent upper or lower spacer, and a cooling pipe through which a cooling medium is circulated is provided in the cooling thick portion.

According to the present invention, the rotor can be sufficiently cooled via the cooling pipe provided in the cooling thick portion of the spacer. Thus, creep speed can be slowed.

DETAILED DESCRIPTION OF PREFERRED EMBODIMENTS

First Embodiment

Figure 1:
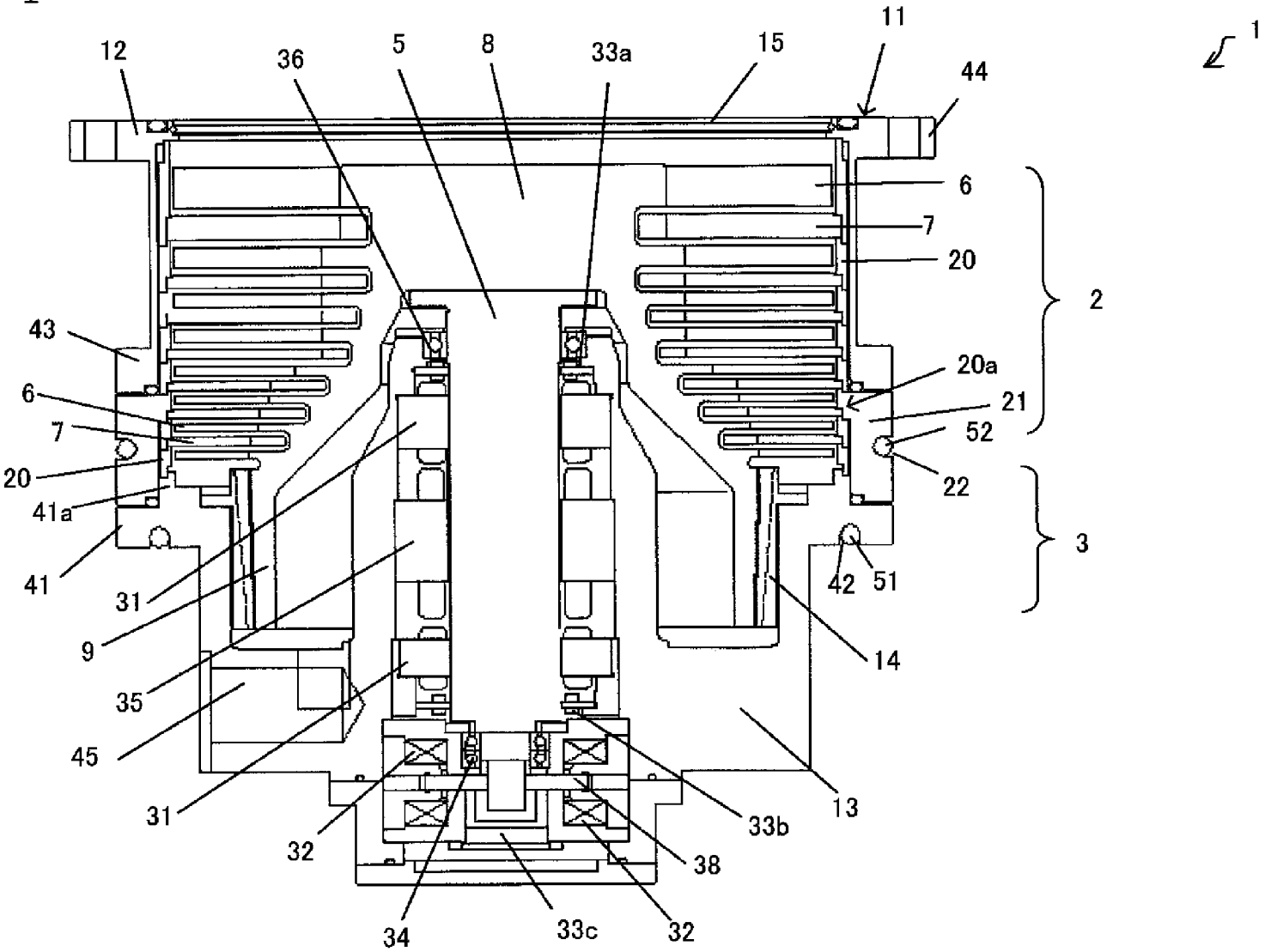
FIG. 1 is a sectional view showing a first embodiment of a turbo-molecular pump according to the present invention.

Hereinafter, a first embodiment of a turbo-molecular pump according to the present invention will be described with reference to the drawings. FIG. 1 is a sectional view of a magnetic bearing type turbo-molecular pump. A turbo-molecular pump 1 includes a case member 11 having an upper case 12 and abase 13. Although details will be described later, a cooling thick portion 21 serving as a part of spacers 20 also forms the case member 11. An upper flange 44 is provided on an upper end side of the upper case 12, and a lower flange 43 is provided on a lower end side. The upper case 12 is formed by, for example, SUS, and the base 13 is formed by, for example, aluminum.

A rotor shaft 5 is arranged on a center axis of the case member 11. A rotor 8 is coaxially attached to the rotor shaft 5. The rotor 8 is formed by, for example, aluminum, and firmly fixed to the rotor shaft 5 by a fastening member (not shown) such as a bolt.

The rotor shaft 5 is contactlessly supported by (two) radial magnetic bearings 31 and (a pair of upper and lower) thrust magnetic bearings 32. A float-up position of the rotor shaft 5 is detected by radial displacement sensors 33*a*, 33*b* and an axial displacement sensor 33*c*. The rotor shaft 5 rotatably and magnetically floated up by the magnetic bearings 31, 32 is driven and rotated at high speed by a motor 35.

A rotor disc 38 is attached to a lower surface of the rotor shaft 5 via a mechanical bearing 34. Further, a mechanical bearing 36 is provided on an upper part side of the rotor shaft 5. The mechanical bearings 34, 36 are mechanical bearings for emergency, and when the magnetic bearings are not operated, the rotor shaft 5 is supported by the mechanical bearings 34, 36.

The rotor 8 has a double structure of an upper part side and a lower part side, and rotor blades 6 in plural steps are provided on the upper part side. A part on the lower side of the lowermost rotor blade 6 serves as a rotor cylindrical portion 9.

A ring shape screw stator 14 is fixed to the base 13 by a fastening member (not shown) on an outer peripheral side of the rotor cylindrical portion 9 of the rotor 8. The screw stator 14 is formed in a substantially cylindrical shape, and a screw groove portion (not shown) is formed on an inner surface side.

The screw stator 14 and a part of the rotor shaft 5 on the lower side of a part corresponding to the screw stator 14 are accommodated in the base 13. A flange 41 whose outer periphery is formed in a circle or a polygon in a plan view is formed in an upper end of the base 13. A groove 42 is formed on a lower surface of the flange 41, and a cooling pipe 51 through which a cooling medium such as cooling water is circulated is provided in the groove 42. An exhaust port 45 is provided in the base 13, and a back pump is connected to this exhaust port 45.

The rotor blades 6 of the rotor 8 are formed in eight steps in the first embodiment, and stator blades 7 in seven steps in total are arranged between the rotor blades 6 and in an upper part of the uppermost rotor blade 6. The spacers 20 in eight steps in total are arranged between the stator blades 7, on the upper side of the uppermost stator blade 7, and on the lower side of the lowermost stator blade 7. Each of the stator blades 7 in the steps is formed in a pair of semi-circles, and each of the spacers 20 is formed in a circle. The stator blades 7 and the spacers 20 are inserted from the outer peripheral direction of the rotor 8, and end surfaces of the both are in contact with each other on a center line passing through a center axis of the rotor shaft 5. The stator blades 7 and the spacers 20 are formed by, for example, aluminum.

One of the eight spacers 20 is pulled out to the outer peripheral side, and an outer peripheral surface is exposed to an exterior. This part serves as the cooling thick portion 21 extended toward the lower side, that is, the side of the base 13. Hereinafter, the spacer 20 having the cooling thick portion 21 will be referred to as a spacer 20*a* to make a difference from the other spacers 20. The cooling thick portion 21 is nipped between the flange 41 of the base 13 and the flange 43 of the upper case 12. An outer peripheral side surface of the cooling thick portion 21 is on the same plane as an outer peripheral side surface of the lower flange 43 of the upper case 12 and an outer peripheral side surface of the flange 41 of the base 13. Further, an inner peripheral side surface of the cooling thick portion 21 is on the same plane as an inner peripheral side surface of the upper case 12. In other words, the inner peripheral side surface of the upper case 12 and the inner peripheral side surface of the cooling thick portion 21 have the same radius from an axis core of the rotor 8.

A groove 22 recessed toward the inner peripheral side is provided on the outer peripheral side surface of the cooling thick portion 21 of the spacer 20*a*, and a cooling pipe 52 through which the cooling medium such as cooling water is circulated is provided in this groove 22.

The stator blades 7 are supported by the spacers 20, 20*a* and arranged between the rotor blades 6. In the first embodiment, the spacer 20*a* having the cooling thick portion 21 is positioned in the sixth step from the upper side, and the five spacers 20 positioned on the further upper side are retained in such a manner that outer peripheral side surfaces thereof are in contact with the inner peripheral side surface of the upper case 12.

The two spacers 20 in the seventh and eighth steps positioned on the lower side of the spacer 20*a* are retained in such a manner that outer peripheral side surfaces thereof are in contact with the inner peripheral side surface of the cooling thick portion 21. A lower end surface of the spacer in the eighth step, that is, the lowermost spacer 20 is supported by an upper step portion 41*a* formed in the flange 41 of the base 13.

The cooling thick portion 21 is placed between the lower flange 43 of the upper case 12 and the flange 41 of the base 13, and coupled by a fastening member (not shown) such as a bolt passing through the lower flange 43, the cooling thick portion 21, and the flange 41 in the thickness direction. Seal members are respectively placed between the lower flange 43 and the cooling thick portion 21 and between the cooling thick portion 21 and the flange 41, so that the case member 11 has a sealed structure.

In such a way, the turbo-molecular pump 1 has a turbine exhaust portion 2 in an internal space formed by the upper case 12 and the cooling thick portion 21, and has a screw groove exhaust portion 3 in an internal space of the base 13. The turbine exhaust portion 2 is formed by the rotor blades 6 in plural steps and the stator blades 7 in plural steps, and the screw groove exhaust portion 3 is formed by the rotor cylindrical portion 9 and the screw stator 14.

The upper flange 44 formed in an upper end of the upper case 12 is fastened to an attachment portion of an exhaust system of a vacuum chamber of a semiconductor device manufacturing apparatus (not shown) or the like by a fastening member (not shown). When the rotor shaft 5 is magnetically floated up and driven and rotated at high speed by the motor 35 in this state, a gas molecule in the vacuum chamber flows in from an intake port 15 provided in an upper part of the upper case 12. The gas molecule flowing in from the intake port 15 is beaten and thrown to the downstream side in the turbine exhaust portion 2. Although not shown, the rotor blades 6 and the stator blades 7 are formed so that the directions of blade inclination are opposite to each other and an inclination angle is gradually changed to an angle by which the gas molecule does not easily reversely flow from the former step side which is the high vacuum side to the latter step side which is the downstream side. The gas molecule is compressed in the turbine exhaust portion 2 and moved to the screw groove exhaust portion 3 on the lower side in the figure.

In the screw groove exhaust portion 3, when the rotor cylindrical portion 9 is rotated at high speed with respect to the screw stator 14, an exhaust function due to a viscous flow is generated, and the gas moved from the turbine exhaust portion 2 to the screw groove exhaust portion 3 is moved to the exhaust port 45 while being compressed, and then exhausted.

When the rotor 8 fixed coaxially with the rotor shaft 5 is rotated at high speed, the rotor blades 6 in the steps collide with the gas molecule suctioned from the intake port 15, then frictional heat is generated, and a temperature of the rotor blades 6 is increased. In this case, conventionally, the frictional heat is transmitted to the rotor blades 6, the stator blades 7, the spacers 20, and the base 13 in this order, and cooled by the cooling medium circulated through the cooing pipe 51 which is provided in the base 13. Meanwhile, in the present embodiment, the frictional heat generated in the rotor blades 6 is cooled by the cooling medium circulated through the cooling pipe 52 which is provided in the cooling thick portion 21 of the spacer 20*a*. Therefore, a cooling effect can be enhanced much more than the conventional example.

Figure 2:
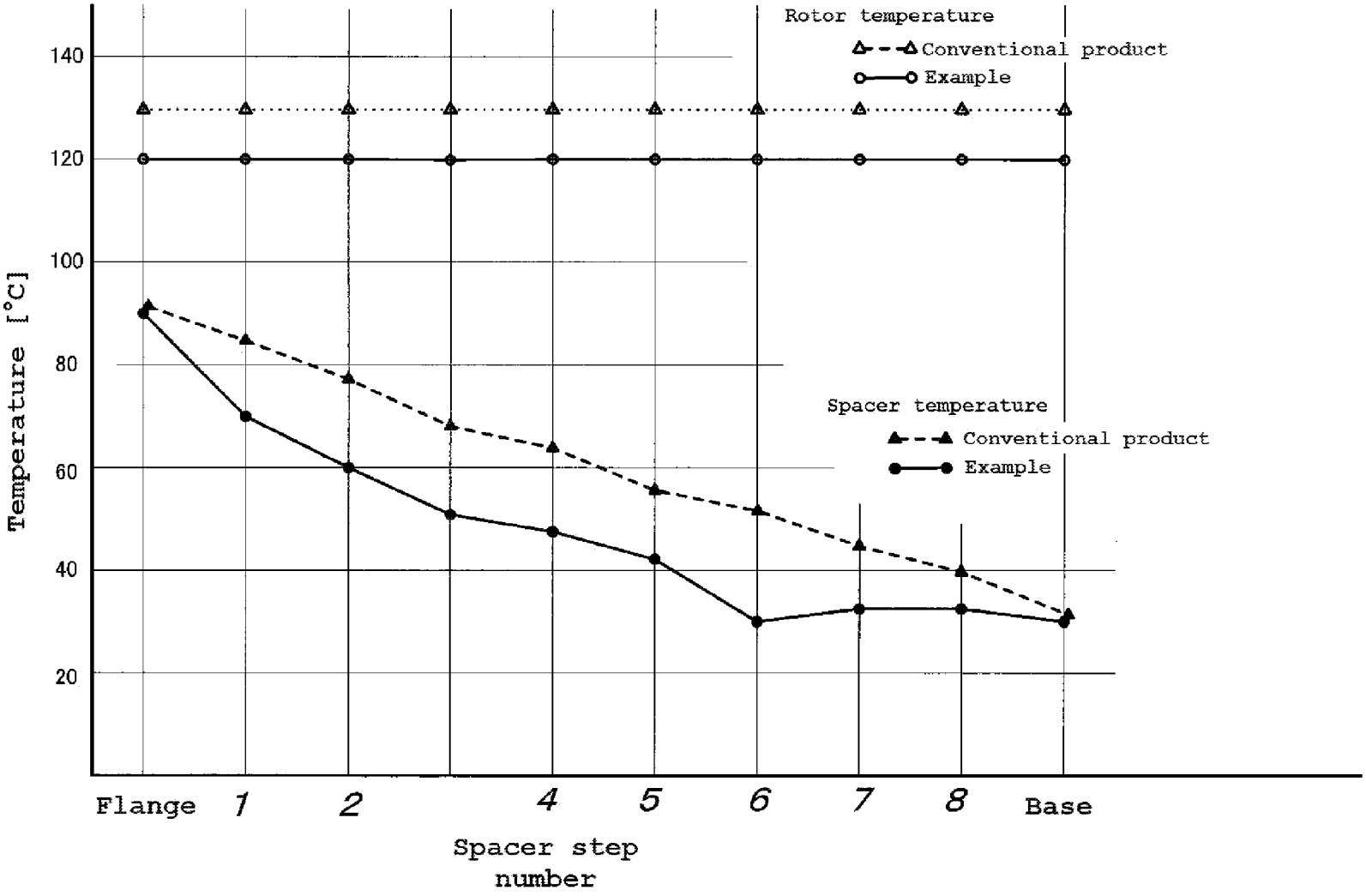
FIG. 2 is a graph showing and comparing a temperature distribution of spacers and a rotor between a conventional product and an example.

FIG. 2 is a graph for comparing a temperature distribution of the spacers 20 and the rotor 8 between the conventional turbo-molecular pump and the turbo-molecular pump of the embodiment (hereinafter, referred to as the example). The conventional turbo-molecular pump includes the cooling pipe 51 only in the flange 41 of the base 13, and hereinafter will be referred to as the comparative example. Both in the comparative example and the example, a temperature of the upper flange 44 of the upper case 12 is 90° C., and a cooling liquid circulated in the cooling pipes 51, 52 is cooling water having a temperature of 25° C. Both a temperature of the spacers 20 and a temperature of the rotor 8 are shown by dotted lines for the conventional product and by solid lines for a case of the example. The spacer step number of the horizontal axis in FIG. 2 indicates the step number from the uppermost step.

In the conventional product, the temperature of the spacers 20 is high on the upper step side and is gradually lowered in a substantially straight form toward the lower step side. Meanwhile, in the first embodiment of the present invention, as described above, an outer peripheral part of the spacer 20*a* in the sixth step is extended to the exterior side which is the atmospheric pressure side so as to form the cooling thick portion 21. The groove 22 is formed on the outer peripheral side surface of the cooling thick portion 21, the cooling pipe 52 is provided in this groove 22, and the cooling water of 25° C. is circulated in the cooling pipe 52. The inner peripheral side surface of the cooling thick portion 21 is in contact with the outer peripheral side surfaces of the spacers 20 in the seventh and eighth steps, so as to retain the spacers 20.

Therefore, in the first embodiment, the spacer 20*a* in the sixth step and the spacers 20 in the seventh and eighth steps are cooled by the cooling water circulated in the cooling pipe 52. By cooling the spacer 20*a* in the sixth step and the spacers 20 in the seventh and eighth steps, the stator blades 7 in the sixth and seventh steps are cooled. By cooling the spacers 20*a*, 20 in the sixth to eighth steps, the spacers 20 and the stator blades 7 in the first to fifth steps are also cooled. Therefore, regarding the temperature of the spacers 20 in the first embodiment, as shown in FIG. 2, the temperature of the intermediate spacers 20 excluding the uppermost spacer 20 and the lowermost spacer 20 can be lower than the comparative example.

When a temperature of the stator blades 7 is lowered, a temperature of the rotor blades 6 is accordingly lowered. Therefore, in comparison to substantially 130° C. in the conventional product, the temperature of the rotor 8 is substantially 120° C. in a case of the present embodiment, so that the temperature can be reduced by about 10° C. In such a way, according to the turbo-molecular pump 1 of the first embodiment, cooling efficiency of the rotor 8 is improved. Thus, creep speed of the rotor 8 can be slowed.

The rotor 8 having the rotor blades 6, the stator blades 7, and the spacers 20, 20*a* are accommodated in the upper case 12 by the following procedure. (1) The lowermost spacer 20 (in the eighth step) is arranged on the upper step portion 41*a* of the flange 41 of the base 13. The spacers 20 are formed as semi-circular members and arranged mutually on the opposite surface side of the rotor shaft 5. (2) The rotor 8 having the rotor blades 6 is arranged on the rotor shaft 5, and fixed to the rotor shaft 5 by the fastening member (not shown). The processes (1), (2) may be performed in the opposite order. (3) The lowermost stator blade 7 (in the seventh step) is inserted from between the lowermost rotor blade 6 (in the eighth step) and the rotor blade 6 in the seventh step, and arranged on the lowermost spacer 20 (in the eighth step). The stator blades 7 are formed as a pair of semi-circular members and respectively inserted from opposite side surfaces of the rotor shaft 5.

(4) The spacer 20 in the seventh step is arranged on the lowermost stator blade 7 (in the seventh step). (5) The stator blade 7 in the sixth step is inserted from between the rotor blades 6 in the seventh and sixth steps, and arranged on the spacer 20 in the seventh step. (6) The spacer 20*a* having the cooling thick portion 21 in which the groove 22 is formed is arranged on the stator blade 7 in the sixth step. At this time, the inner peripheral side surface of the cooling thick portion 21 is brought into contact with the outer peripheral side surfaces of the spacers 20 in the seventh and eighth steps, so as to retain the spacers 20 in the seventh and eighth steps.

(7) Hereinafter, the stator blades 7 in the fifth to first steps and the spacers 20 in the fifth to first steps are alternately arranged. (8) After the uppermost spacer 20 (in the first step) is arranged on the uppermost stator blade 7 (in the first step), the upper case 12 is lowered from the upper side, so that the spacers 20 in the first to fifth steps, the stator blades 7 in the first to fifth steps, and the upper part side of the rotor 8 are accommodated in the upper case 12. At this time, a lower surface of the lower flange 43 of the upper case 12 is mounted on an upper surface of the cooling thick portion 21. (9) As described above, by coupling the lower flange 43, the cooling thick portion 21, and the flange 41 by the fastening member (not shown) such as a bolt passing through in the thickness direction, the case member 11 sealed from the exterior is formed in a coupled part. It should be noted that the seal members are respectively placed between the lower flange 43 and the cooling thick portion 21 in the process (6) and between the cooling thick portion 21 and the flange 41 in the process (9).

Second Embodiment

Figure 3:
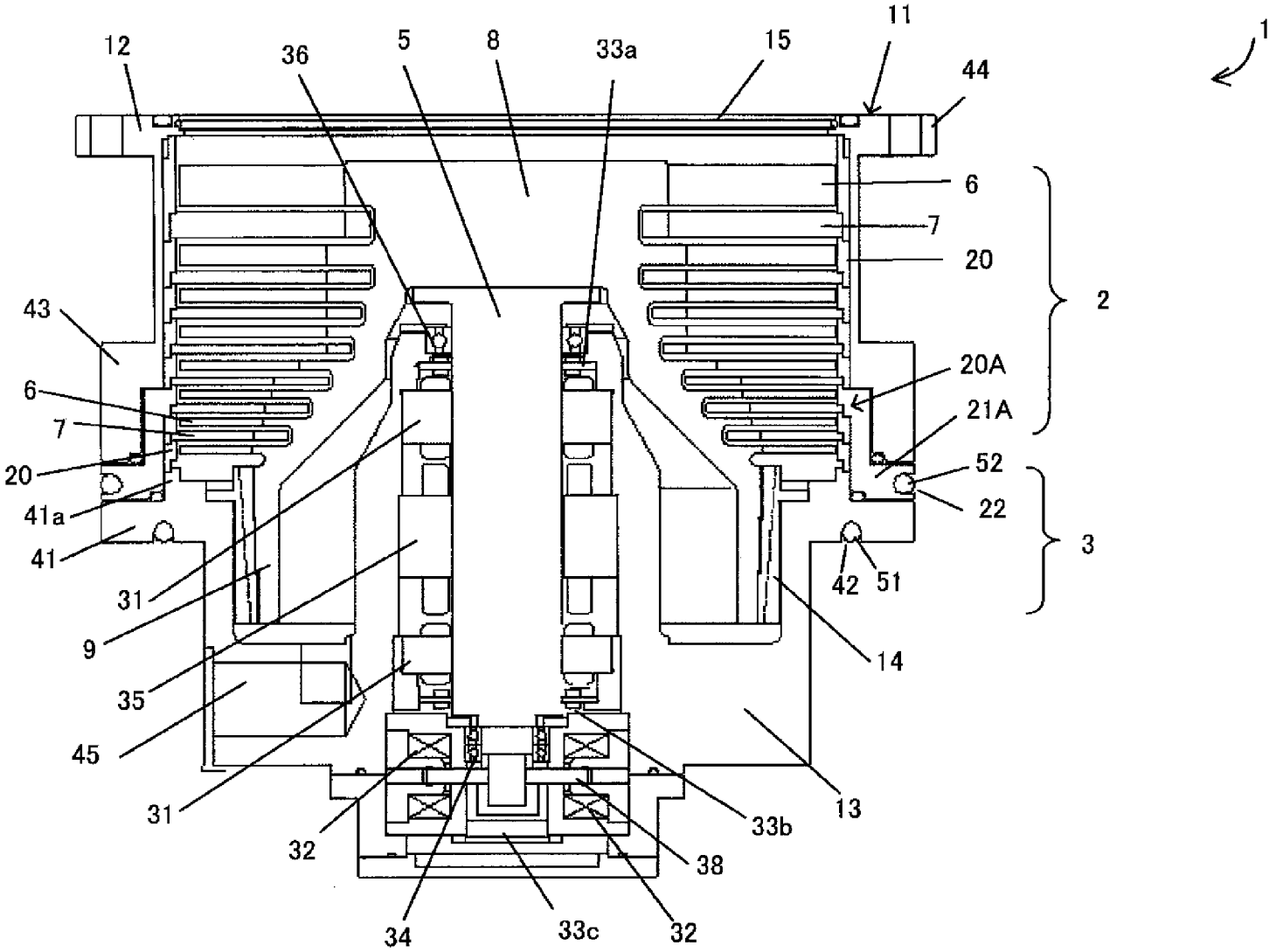
FIG. 3 is a sectional view showing a second embodiment of the turbo-molecular pump of the present invention.

FIG. 3 is a sectional view of a second embodiment of the turbo-molecular pump 1 of the present invention. The second embodiment is different from the first embodiment shown in FIG. 1 at a point that only a part of an outer peripheral side surface of a cooling thick portion 21A of a spacer 20A is exposed to the exterior. That is, the entire outer peripheral side surface of the cooling thick portion 21 of the spacer 20*a* shown in FIG. 1 is exposed to the exterior. Meanwhile, in the spacer 20A shown in FIG. 3, only a lower part side which is a part of the outer peripheral side surface of the cooling thick portion 21A is exposed to the exterior, and an upper part side is covered by the lower flange 43 of the upper case 12.

The upper case 12 is formed by, for example, SUS, and the spacers 20, 20A are formed by, for example, aluminum having high heat conductivity. In the second embodiment, since the upper part side of the spacer 20A is covered by the lower flange 43 of the upper case 12, the spacer 20A having small tensile strength is protected by the upper case 12. Therefore, in a case where the rotor 8 of the turbo-molecular pump 1 is broken, breaking energy can be absorbed by the case member 11.

In the second embodiment, the cooling pipe 52 is provided in the groove 22 provided on the outer peripheral side surface on the lower part side exposed to the exterior in the cooling thick portion 21A. The cooling pipe 52 can be provided in a part covered by the lower flange 43 of the upper case 12 in the cooling thick portion 21A. However, when the cooling pipe 52 is provided in the part covered by the lower flange 43, a structure of processing the cooling medium leaked out from the cooling pipe 52 becomes complicated. Therefore, the cooling pipe 52 is desirably provided in the facing part on the outer peripheral side surface exposed to the exterior in the cooling thick portion 21A. It should be noted that other configurations in the second embodiment are the same as the first embodiment, the same reference signs are given to the corresponding members, and description thereof is not repeated.

Third Embodiment

Figure 4:
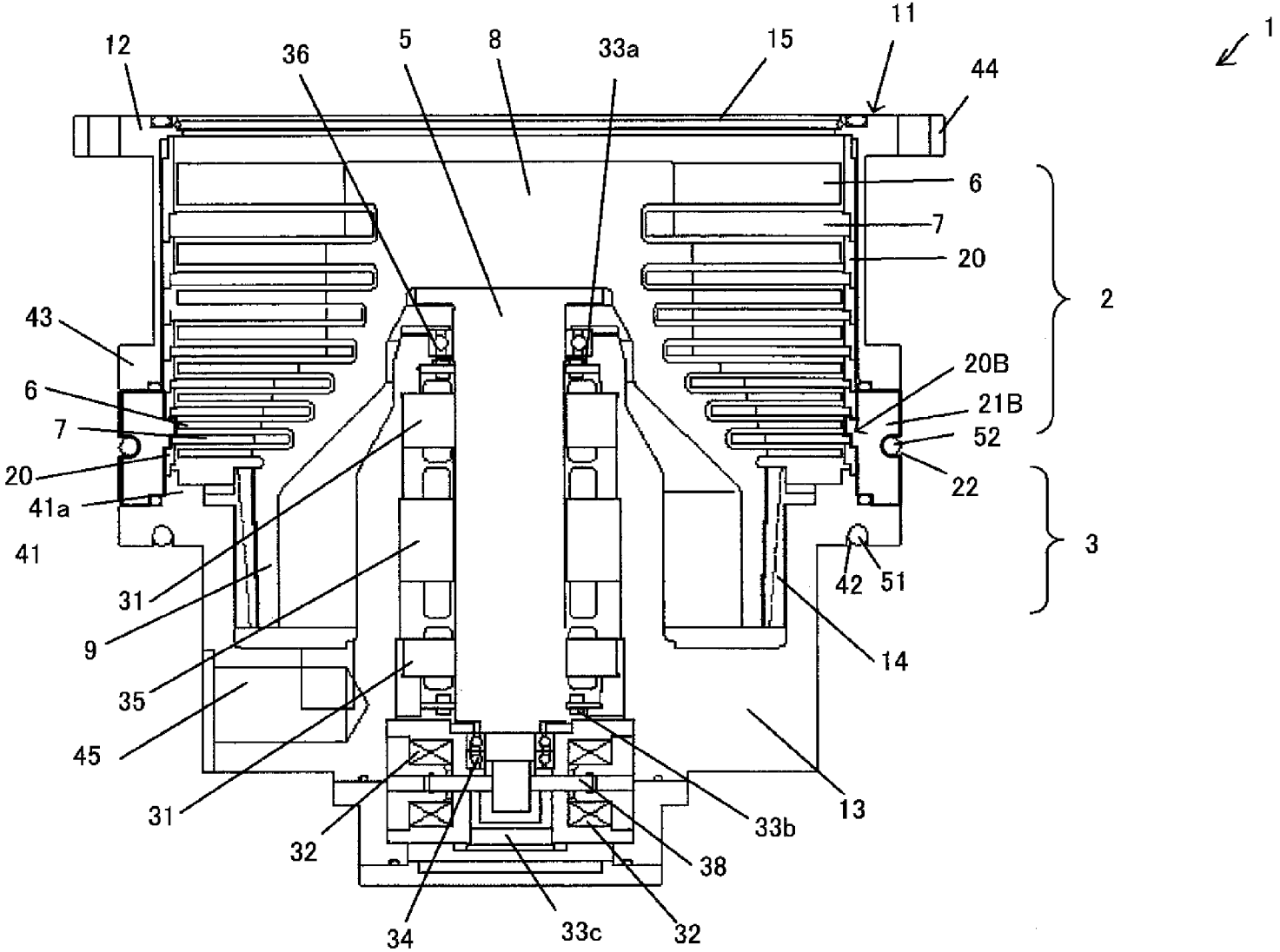
FIG. 4 is a sectional view showing a third embodiment of the turbo-molecular pump of the present invention.

FIG. 4 is a sectional view of a third embodiment of the turbo-molecular pump 1 of the present invention. The third embodiment is different from the first embodiment shown in FIG. 1 at a point that the spacer 20 in the seventh step from the top, in other words, in the second step from the lowermost step serves as a spacer 20B having a cooling thick portion 21B. The cooling thick portion 21B of the spacer 20B is extended on an upper side and a lower side, and the upper side covers the outer peripheral side surface of the adjacent upper spacer 20. The lower side covers the outer peripheral side surface of the adjacent lower spacer 20, and is supported by an upper surface of the flange 41 of the base 13. The turbo-molecular pump 1 of the third embodiment also exerts the same effect as a case of the first embodiment. Other configurations in the third embodiment are the same as the first embodiment, the same reference signs are given to the corresponding members, and description thereof is not repeated.

Fourth Embodiment

Figure 5:
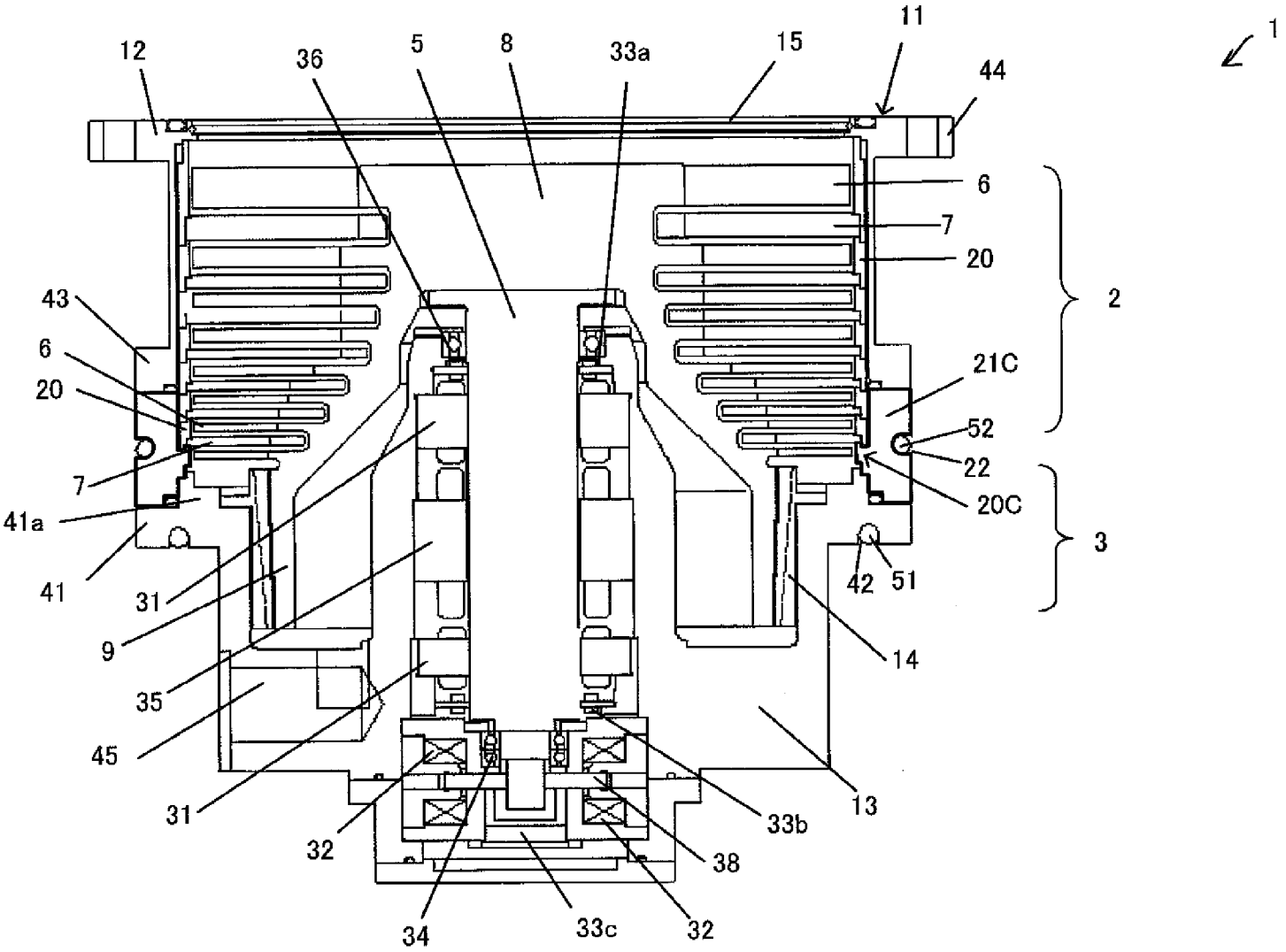
FIG. 5 is a sectional view showing a fourth embodiment of the turbo-molecular pump of the present invention.

FIG. 5 is a sectional view of a fourth embodiment of the turbo-molecular pump 1 of the present invention. The fourth embodiment is different from the first embodiment shown in FIG. 1 at a point that the spacer 20 in the eighth step from the top, in other words, in the lowermost step serves as a spacer 20C having a cooling thick portion 21C. The cooling thick portion 21C of the spacer 20C is extended on an upper side and a lower side, and the upper side covers the outer peripheral side surfaces of the two adjacent upper spacers 20. The lower side is extended on the side of the base 13, and a lower surface is supported by the upper surface of the flange 41. The turbo-molecular pump 1 of the fourth embodiment also exerts the same effect as a case of the first embodiment. Other configurations in the fourth embodiment are the same as the first embodiment, the same reference signs are given to the corresponding members, and description thereof is not repeated.

As described above, in the turbo-molecular pump 1 shown in the embodiments of the present invention, the spacers 20*a*, 20A to 20C are extended on the outer peripheral side so as to form the cooling thick portions 21, 21A to 21C, and the cooling pipe 52 through which the cooling medium is circulated is provided in the cooling thick portions 21, 21A to 21C. Therefore, the cooling effect of the rotor 8 can be enhanced, the creep speed of the rotor 8 can be slowed, and the life of the turbo-molecular pump 1 can be extended. The groove 22 recessed to the inner side is provided in the part of the cooling thick portions 21, 21A to 21C where the outer peripheral side surfaces are exposed, and the cooling pipe 52 is provided in this groove 22. Therefore, a structure of easily processing the cooling medium leaked out from the cooling pipe 52 can be obtained. Although the cooling pipes 51 and 52 are provided in the above embodiments, at least the cooling pipe 51 is required to be provided.

It should be noted that in the turbo-molecular pump 1 shown in FIGS. 4 and 5 as the third and fourth embodiments, a part of the outer peripheral side surfaces of the cooling thick portions 21B, 21C may be covered by the upper case 12 as well as a case shown in FIG. 3 as the second embodiment. The outer peripheral side surfaces of the cooling thick portions 21A to 21C may be covered by the base 13 or may be covered by both the upper case 12 and the base 13.

In the above embodiments, the spacers 20*a*, 20A to 20C having the cooling thick portions 21, 21A to 21C are shown as examples of the spacer 20 in the sixth step from the uppermost step. However, a position where the spacer having the cooling thick portion is provided is not limited to this position. The temperature of the spacers 20 is higher on the downstream side. Thus, it is preferable that the lowermost spacer 20 is included and the spacers 20 in several steps on the upper side of this spacer are cooled at maximum. Therefore, the cooling thick portion is effectively provided in any of one second to one third of the spacers 20 in the lower steps among the spacers 20 in the entire steps. Further, by covering the outer peripheral side surfaces of all the spacers positioned on the lower side of the cooling thick portion by the cooling thick portion, the cooling effect can be more enhanced. The number of the spacers covered by the cooling thick portion is preferably less than the number of the spacers not covered by the cooling thick portion. Thereby, the spacers covered by the cooling thick portion can be efficiently cooled in a focused manner.

In the above embodiments, the turbo-molecular pump 1 having the rotor blades 6 in eight steps is shown as an example. However, the present invention can also be applied to a turbo-molecular pump 1 of the other step number having rotor blades 6, for example, in six to ten steps. The present invention can also be applied to a turbo-molecular pump in which a power source device is integrally provided in a case member 11.

In addition, the present invention can be variously modified and applied within the scope of the gist of the invention. In sum, the cooling thick portion is required to be formed in one of the spacers for supporting the stator blades and the cooling pipe through which the cooling medium is circulated is required to be provided in this cooling thick portion.

What is claimed is:

1. A turbo-molecular pump comprising:

a turbo-molecular pump case;

a rotor accommodated in the turbo-molecular pump case, the rotor having rotor blades arranged in multiple steps;

a rotor shaft provided coaxially with the rotor;

a plurality of stator blades provided in the turbo-molecular pump case and arranged between the rotor blades; and a plurality of spacers for supporting the stator blades, wherein one of the plurality of spacers has a cooling thick portion which covers an outer peripheral side surface of at least one of an adjacent upper spacer and an adjacent lower spacer included among the plurality of said spacers, and a cooling pipe through which a cooling medium is circulated is provided in the cooling thick portion.

2. The turbo-molecular pump according to claim 1, wherein the cooling pipe is provided in a part of an outer peripheral side surface of the cooling thick portion exposed from the turbo-molecular pump case.

3. The turbo-molecular pump according to claim 1, wherein the turbo-molecular pump case has an upper case and a base, and the cooling thick portion is fixed between the upper case and the base.

4. The turbo-molecular pump according to claim 3, wherein a part of an outer peripheral side surface of the cooling thick portion is covered by the upper case.

5. The turbo-molecular pump according to claim 1, wherein outer peripheral side surfaces of the plurality of said spacers positioned on a lower side of the cooling thick portion are covered by the cooling thick portion.

* * * * *